US012618256B1

(12) United States Patent
Sun et al.

(10) Patent No.: US 12,618,256 B1
(45) Date of Patent: May 5, 2026

(54) HOUSE

(71) Applicant: Wenqing Sun, Changsha (CN)

(72) Inventors: Wenqing Sun, Changsha (CN); Cheng Tian, Changsha (CN); Hongyan Zhang, Changsha (CN); Yu Tian, Changsha (CN)

(73) Assignee: Wenqing Sun, Changsha (CN)

( * ) Notice: Subject to any disclaimer, the term of this patent is extended or adjusted under 35 U.S.C. 154(b) by 0 days.

(21) Appl. No.: 19/066,193

(22) Filed: Feb. 28, 2025

(51) Int. Cl.

| | |
|---|---|
| ***E04H 9/02*** | (2006.01) |
| ***E04H 9/00*** | (2006.01) |
| *E04B 1/64* | (2006.01) |
| *E04H 9/10* | (2006.01) |

(52) U.S. Cl.
CPC ..... *E04H 9/021* (2013.01); *E04H 9/00* (2013.01); *E04B 1/64* (2013.01); *E04H 9/02* (2013.01); *E04H 9/028* (2013.01); *E04H 9/10* (2013.01)

(58) Field of Classification Search
None
See application file for complete search history.

(56) References Cited

U.S. PATENT DOCUMENTS 4,228,788 A * 10/1980 Moeser ..... E04H 9/16 165/104.19
5,303,524 A * 4/1994 Caspe ..... E04H 9/0237 52/167.2
5,323,573 A * 6/1994 Bakewell, III ..... E04B 1/3205 52/223.7
2005/0257451 A1* 11/2005 Pryor ..... E04B 1/98 52/167.4
2008/0176040 A1* 7/2008 Ilfrey ..... B29B 7/7419 428/150
2009/0029086 A1* 1/2009 Wallin ..... E04F 15/02 428/44
2012/0216476 A1* 8/2012 Naidoo ..... E04C 2/20 52/794.1
2019/0376277 A1* 12/2019 Chavanne ..... E04B 1/34384
2019/0382622 A1* 12/2019 Seabaugh ..... C09J 5/00
2021/0115660 A1* 4/2021 Amend ..... E04C 2/205
2022/0251798 A1* 8/2022 Lolley ..... E04B 1/7069

* cited by examiner

*Primary Examiner* — Phi D Tran
(74) *Attorney, Agent, or Firm* — Hemisphere Law, PLLC

(57) ABSTRACT

A house includes a base, a house body and a partition plate. The house body is located above the base. Two sides of the partition plate are abutted against the base and the house body, respectively. The base, the house body and the partition plate are configured to be relatively movable. When natural disasters occur, the house body can move relative to the partition plate and the base to absorb and disperse impact forces from the natural disasters. This improves seismic and wind resistance capabilities of an overall structure of the house, thereby reducing possibility of direct collapse of the house, providing valuable escape time for users, and minimizing casualties and property losses. In addition, a structure of the house body is a reinforced concrete structure, windows are made of aluminum alloy, and doors are fireproof doors. Therefore, the house can also have good fire resistance performance.

12 Claims, 2 Drawing Sheets

HOUSE

TECHNICAL FIELD

The disclosure relates to the field of building technologies, and more particularly to a house.

BACKGROUND

With the acceleration of urbanization, population density in cities is continuously increasing. In this context, safety performance of house building has become a focus of societal concern.

Due to limitations in structural design and material selection, traditional house building often exhibits vulnerability in the face of natural disasters such as earthquakes and typhoons, resulting in low safety performance. Once a disaster occurs, it will not only cause a large number of casualties, but also result in huge property losses, imposing a significant burden on social and economic development. Therefore, improving the safety performance of the house building is not only a guarantee for individual life and property safety, but also an important measure to reduce overall social risks and promote sustainable development.

SUMMARY

In view of the above conditions, the disclosure provides a house to solve a problem of low safety performance in house building in the related art.

The disclosure provides a house, including: a base, a house body and a partition plate. The house body is located above the base. Two sides of the partition plate are abutted against the base and the house body, respectively. The base, the house body and the partition plate are configured to be relatively movable.

In an embodiment, the partition plate is a stainless steel plate.

In an embodiment, the house further includes a first film, and the first film is disposed between the base and the partition plate.

In an embodiment, the house further includes a second film, and the second film is disposed between the house body and the partition plate.

In an embodiment, the house body includes an outer wall and an inner wall. The outer wall is enclosed to define an inner space of the house body, and the inner wall is configured to partition the inner space of the house body. A thickness of each of the outer wall and the inner wall is 10 centimeters (cm).

In an embodiment, the house further includes solar panels. The house body includes a roof located at a top of the house body, and a top of the roof is covered with the solar panels.

In an embodiment, the house body is provided with shielding windows, and the shielding windows include double-glazed glass.

In an embodiment, the house body is provided with fire-proof and anti-theft doors.

In an embodiment, the house body is integrally formed.

In an embodiment, a height of the house is less than or equal to 16 meters (m).

The house provided by the disclosure includes the base, the house body and the partition plate. The house body is located above the base, and the two sides of the partition plate are abutted against the base and the house body, respectively. The base, the house body and the partition plate are configured to be relatively movable. As a result, when natural disasters such as earthquakes or typhoons occur, the house body can move relative to the partition plate and the base to absorb and disperse impact forces from the natural disasters. This improves seismic and wind resistance capabilities of an overall structure of the house, thereby reducing possibility of direct collapse of the house, providing valuable escape time for users, and minimizing casualties and property losses as much as possible.

BRIEF DESCRIPTION OF DRAWINGS

In order to more clearly illustrate the technical solutions of the embodiments of the disclosure, a brief introduction to the accompanying drawings used in the description of the embodiments will be provided below. It is apparent that the accompanying drawings described below are merely some embodiments of the disclosure. For those skilled in the art, other accompanying drawings can be obtained based on these accompanying drawings without creative labor.

In order to have a more complete understanding of the disclosure and its beneficial effects, the following description will be provided in conjunction with the accompanying drawings, in which the same numeral references in the following description represent the same parts.

DESCRIPTION OF REFERENCE SIGNS

1—base; 2—house body; 3—partition plate; 4—first film; 5—second film; 6—solar panel; 7—outer wall; 8—inner wall; 9—roof; 10—shielding window; 11—fire-proof and anti-theft door.

DETAILED DESCRIPTION OF EMBODIMENTS

Hereinafter, with reference to the accompanying drawings, the specific embodiments of the disclosure will be described in detail. In the following description, same numeral references are assigned to same components, and repeated explanations are omitted. Additionally, the accompanying drawings are merely schematic illustrations, and the proportions of dimensions between components or the shapes of components may differ from those in actuality. It should be noted that all directional indications (such as up, down, left, right, front, back, etc.) used in the embodiments of the disclosure are solely for the purpose of explaining the relative positional relationships between components and their motion conditions under a specific posture. If this specific posture changes, the directional indications will also correspondingly change.

It should also be noted that when an element is referred to as being "fixed on" or "disposed on" another element, it may be directly on the another element or may have an intermediate element therebetween. When an element is referred to as being "connected to" another element, it may be directly connected to the another element or may have an intermediate element therebetween.

Figure 1:
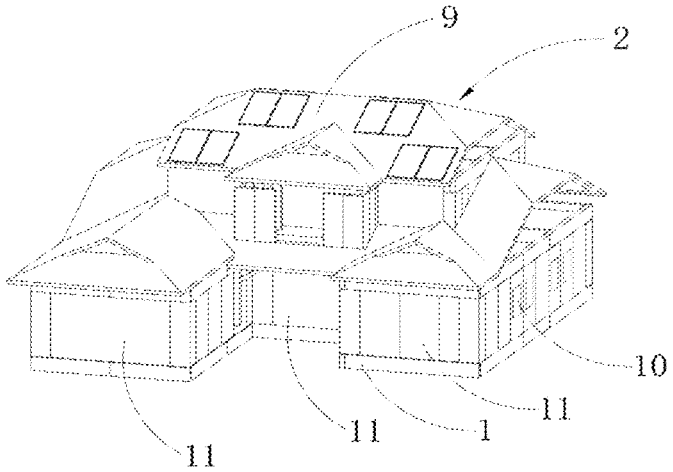
FIG. 1 illustrates a schematic diagram of an overall structure of a house provided by the disclosure.
Figure 2:
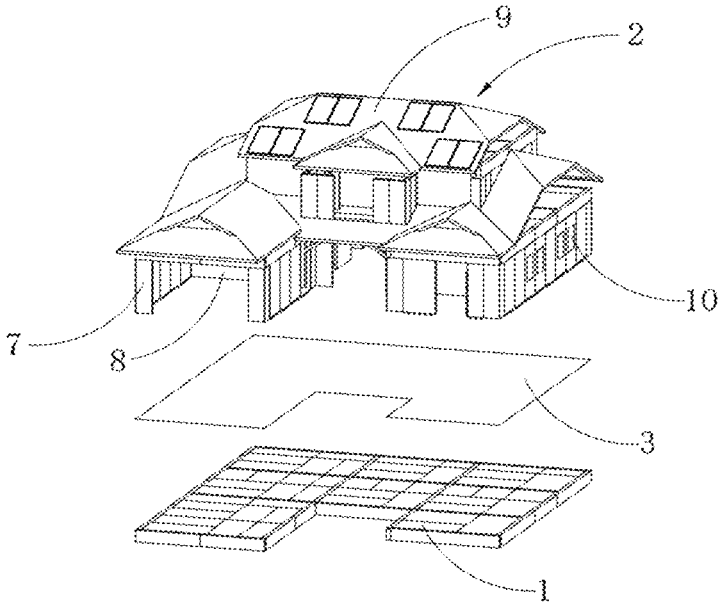
FIG. 2 illustrates an exploded view of the house provided by the disclosure.
Figure 3:
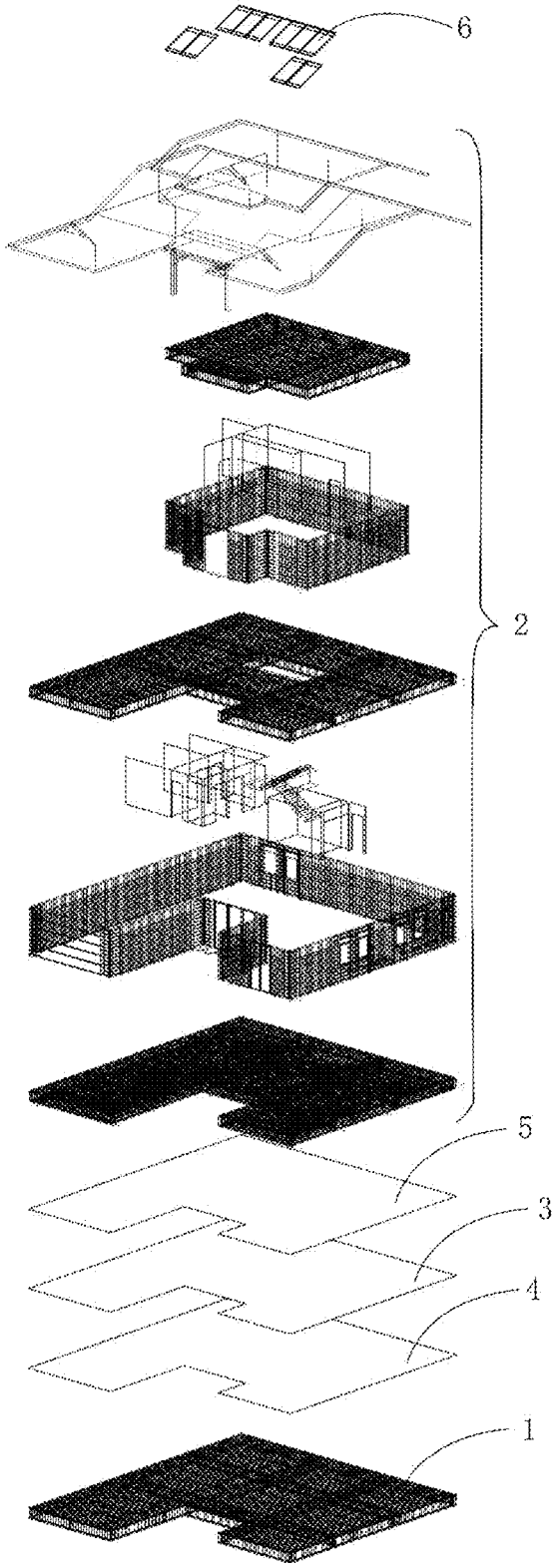
FIG. 3 illustrates another exploded view of the house provided by the disclosure.

Referring to FIGS. 1-3, the disclosure provides a house. The house includes a base 1, a house body 2 and a partition plate 3. The house body 2 is located above the base 1. Two sides of the partition plate 3 are abutted against the base 1 and the house body 2, respectively. The base 1, the house body 2 and the partition plate 3 are configured to be relatively movable. In addition, a structure of the house body 2 is a reinforced concrete structure, windows are made of aluminum alloy, and doors are fireproof doors. Therefore, the house can also have good fire resistance performance.

According to the above structure, when natural disasters such as earthquakes or typhoons occur, the house body 2 can move relative to the partition plate 3 and the base 1 to absorb and disperse impact forces from the natural disasters. This improves seismic and wind resistance capabilities of an overall structure of the house, thereby reducing possibility of direct collapse of the house, providing valuable escape time for users, and minimizing casualties and property losses as much as possible.

In some embodiments, the partition plate 3 is a stainless steel plate. As a result, using the stainless steel plate as the partition plate 3 ensures long-term stability of the overall structure of the house due to its high strength and corrosion resistance. Using the stainless steel plate also reduces friction between the house body 2 and the base 1 during the earthquakes, allowing the house to move more flexibly and thereby minimizing structural damage to the house.

In some embodiments, the house body 2 may be constructed with the reinforced concrete structure. In other embodiments, the base 1 may be constructed as a beam and have a reinforced concrete structure for the bottom plate. The base 1 mainly serves a load-bearing function, and the base 1 constructed by the beam can effectively distribute and transfer loads from the house body 2, thereby improving stability of the overall structure of the house. In addition, the bottom plate of the reinforced concrete structure has excellent moisture-proof properties, which effectively prevents water penetration and protects an inner of the house from dampness and mold growth, thereby improving living comfort.

Referring to FIG. 3, in some embodiments, the house further includes a first film 4. The first film 4 is disposed between the base 1 and the partition plate 3. As a result, the first film 4 can effectively isolate the base 1 from the partition plate 3, thereby preventing adhesion between the base 1 and the partition plate 3 during construction.

Referring to FIG. 3, in some embodiments, the house further includes a second film 5. The second film 5 is disposed between the house body 2 and the partition plate 3. As a result, the second film 5 can effectively isolate the house body 2 from the partition plate 3, thereby preventing adhesion between the house body 2 and the partition plate 3 during the construction.

In some embodiments, the house body 2 includes an outer wall 7 and an inner wall 8. The outer wall 7 is enclosed to define an inner space of the house body 2, and the inner wall 8 is configured to partition the inner space of the house body 2. A thickness of each of the outer wall and the inner wall is 10 cm. As a result, the thickness of both the outer wall 7 and inner wall 8 reaches 10 cm, which provides better structural strength and thermal insulation performance. This design enables the house to better withstand the natural disasters, thereby improving its seismic and fireproof performance. Specifically, in a case of an external fire threat, a thicker outer wall ensures safety of the inner space by effectively preventing the spread of fire to the inner space, thereby protecting property and structure of the house from damage. In a case of an indoor fire, a sufficiently thick inner wall also prevents the spread of fire to other rooms, achieving effective isolation between rooms and minimizing damage to a greatest extent.

In some embodiments, the house further includes solar panels 6. The house body 2 includes a roof 9 located at a top of the house body 2, and a top of the roof 9 is covered with the solar panels 6. As a result, installing solar panels 6 on the top of the house can not only provide clean energy and reduce energy costs, but also reduce dependence on traditional energy sources.

In some embodiments, the house body 2 is provided with shielding windows 10, and the shielding windows 10 include double-glazed glass. Specifically, a structure of the double-glazed glass can improve wind resistance and pressure resistance of the shielding windows 10, helping to reduce damage from extreme weather conditions such as typhoons and ensuring living safety. In addition, an air layer or a vacuum layer between two panels of the double-glazed glass serves as an insulating barrier, effectively blocking the transfer of heat. In summer, the double-glazed glass can prevent high outdoor temperatures from entering indoors, lowering indoor temperatures and reducing a need for air conditioning, thereby saving energy. In winter, the double-glazed glass can prevent indoor heat from escaping, maintaining indoor warmth and similarly reducing heating energy consumption.

In some embodiments, the shielding windows are made of aluminum alloy, which can isolate fire source and prevent the spread of flames during a fire, thereby providing high fire resistance.

In some embodiments, the house body 2 is provided with fire-proof and anti-theft doors 12. As a result, the fire-proof and anti-theft doors 12 can effectively isolate the fire source, thereby providing valuable escape time for residents.

In some embodiments, the house body 2 is integrally formed. As a result, the integral formation of the house body 2 can simplify a construction process, and reduce a number of joints and seams, thereby improving overall strength and stability of the house.

In some embodiments, a height of the house is less than or equal to 16 m. As a result, in the embodiment, the house can be a low-rise house with a number of floors being less than or equal to 5. The house is capable of withstanding earthquakes up to magnitude 12 and typhoons with wind speeds up to level 12. In addition, the house can achieve a first-class fire resistance rating, ensuring that the house body 2 will not sustain significant damage.

In summary, by adopting the house provided by the disclosure, when the natural disasters such as the earthquakes or the typhoons occur, the house body 2 can move relative to the partition plate 3 and the base 1 to absorb and disperse the impact forces from the natural disasters. This improves the seismic and wind resistance capabilities of the overall structure of the house, thereby reducing the possibility of direct collapse of the house, providing the valuable escape time for the users, and minimizing the casualties and the property losses as much as possible.

In the description of the disclosure, the terms "first" and "second" are used solely for descriptive purposes and should not be construed as indicating or implying relative importance or implying the number of technical features indicated. Therefore, features defined by "first" and "second" may explicitly or implicitly include one or more features. In the description of the disclosure, the term "multiple" means two or more, unless otherwise specifically limited.

In the above embodiments, the description of each embodiment has its own emphasis. For parts not detailed in one embodiment, reference can be made to the relevant descriptions in other embodiments.

The embodiments, implementation methods, and related technical features of the disclosure can be combined with or substituted for each other without conflict.

The above are merely the specific embodiments of the disclosure and are not intended to limit the disclosure in any form. Any simple modifications, equivalent changes, or embellishments made to the above embodiments without departing from the content of the technical solutions of the disclosure, and in accordance with the technical essence of the disclosure, shall still fall within the scope of the technical solutions of the disclosure.

Although the disclosure has been specifically described above in conjunction with the accompanying drawings and embodiments, it can be understood that the above description does not limit the disclosure in any form. Those skilled in the art can make modifications and variations to the disclosure as needed without departing from the essential spirit and scope of the disclosure, and these modifications and variations all fall within the scope of the disclosure.

What is claimed is:

1. A house, comprising:

a base, having a reinforced concrete structure and serving a load-bearing function;

a house body, located above the base, wherein the house body is an integrally formed reinforced concrete structure; and a partition plate, wherein the partition plate is a one-piece stainless steel plate sandwiched between the base and the house body, and the partition plate is only supported on the base and without mechanical connection with the base and thus the partition plate is movable relative to the base;

wherein the base, the house body and the partition plate are configured to be relatively movable, and thereby the house body can move relative to the base to absorb and disperse impact force from a natural disaster when the natural disaster occurs.

2. The house as claimed in claim 1, wherein the house further comprises a first film, and the first film is disposed between the base and the partition plate and configured to isolate the base from the partition plate, thereby preventing adhesion between the base and the partition plate during construction of the house.

3. The house as claimed in claim 2, wherein the house further comprises a second film, the second film is disposed between the house body and the partition plate and configured to isolate the house body from the partition plate, thereby preventing adhesion between the house body and the partition plate during the construction of the house; and the base, the first film, the partition plate, the second film and the house body are sequentially stacked in that order.

4. The house as claimed in claim 1, wherein the house body comprises an outer wall and an inner wall;

wherein the outer wall is enclosed to define an inner space of the house body, and the inner wall is configured to partition the inner space of the house body; and wherein a thickness of each of the outer wall and the inner wall is 10 centimeters (cm).

5. The house as claimed in claim 1, wherein the house further comprises solar panels; and wherein the house body comprises a roof located at a top of the house body, and a top of the roof is covered with the solar panels.

6. The house as claimed in claim 1, wherein the house body is provided with shielding windows, and the shielding windows comprise double-glazed glass.

7. The house as claimed in claim 1, wherein the house body is provided with fire-proof and anti-theft doors.

8. The house as claimed in claim 1, wherein a height of the house is less than or equal to 16 meters (m).

9. The house as claimed in claim 1, wherein the base is constructed as a beam structure.

10. The house as claimed in claim 1, wherein the natural disaster comprises earthquake or typhoon.

11. A house, comprising:

a base, having a reinforced concrete structure and serving a load-bearing function;

a house body, located above the base, wherein the house body is constructed with a reinforced concrete structure and comprises an outer wall and an inner wall, the outer wall is enclosed to define an inner space of the house body, and the inner wall is configured to partition the inner space of the house body; and a partition plate, wherein the partition plate is sandwiched between the base and the house body and thereby the base, the partition plate and the house body are sequentially arranged in that order, the partition plate is only supported on the base and without mechanical connection with the base and thus the partition plate is movable relative to the base;

wherein the house body is movable relative to the base so as to absorb and disperse impact force from a natural disaster when the natural disaster occurs.

12. The house as claimed in claim 11, wherein the house further comprises a first film and a second film, the first film is disposed between the base and the partition plate, the second film is disposed between the house body and the partition plate, and thereby the base, the first film, the partition plate, the second film and the house body are sequentially stacked in that order;

wherein the first film is configured to isolate the base from the partition plate, thereby preventing adhesion between the base and the partition plate during construction of the house;

wherein the second film is configured to isolate the house body from the partition plate, thereby preventing adhesion between the house body and the partition plate during the construction of the house.

* * * * *